US011920413B1

(12) United States Patent
AlFaraj et al.

(10) Patent No.: US 11,920,413 B1
(45) Date of Patent: Mar. 5, 2024

(54) QUANTIFICATION AND MINIMIZATION OF WELLBORE BREAKOUTS IN UNDERBALANCED DRILLING

(71) Applicant: SAUDI ARABIAN OIL COMPANY, Dhahran (SA)

(72) Inventors: Rima Taqi AlFaraj, Al Qatif (SA); Khalid Mohammed Alruwaili, Dammam (SA); Aijaz Ali Shaikh, Dhahran (SA); Otto Meza, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/048,786

(22) Filed: Oct. 21, 2022

(51) Int. Cl.
*E21B 21/06* (2006.01)
*E21B 44/00* (2006.01)
(Continued)

(52) U.S. Cl.
CPC ..... *E21B 21/06* (2013.01); *E21B 44/00* (2013.01); *E21B 47/022* (2013.01); *E21B 49/00* (2013.01); *E21B 2200/20* (2020.05)

(58) Field of Classification Search
CPC ..... E21B 21/06; E21B 44/00; E21B 47/002; E21B 49/00; E21B 2200/20
See application file for complete search history.

(56) References Cited

U.S. PATENT DOCUMENTS 6,609,067 B2 * 8/2003 Tare ..... E21B 49/00 702/9
8,818,779 B2 8/2014 Sadlier et al.
(Continued)

FOREIGN PATENT DOCUMENTS

WO 2022/026879 A1 2/2022

OTHER PUBLICATIONS

Dahab, A. S. et al., "Managing Wellbore Instability through Geomechanical Modeling and Wellbore Stability Analysis"; Proceedings of the 54th U.S. Rock Mechanics/Geomechanics Symposium; Paper No. ARMA-2020-1378; Jun. 28, 2020 (9 pages).
(Continued)

*Primary Examiner* — Yong-Suk (Philip) Ro
(74) *Attorney, Agent, or Firm* — Osha Bergman Watanabe & Burton LLP

(57) ABSTRACT

Methods and systems for quantifying and minimizing wellbore breakouts are disclosed. The methods include obtaining a mechanical earth model (MEM), determining a critical collapse pressure (CCP) using an inclination angle and the MEM, and determining an initial mud weight based on the CCP. The methods also include generating a breakout analysis using the initial mud weight, the MEM and a numerical modeling algorithm, updating the inclination angle of the planned wellbore, updating the CCP based on the updated inclination angle and the MEM, and updating the breakout analysis using the initial mud weight, the updated CCP, the MEM, and the numerical modeling algorithm. The methods further include selecting the updated CCP based, on the updated inclination angle that meets the stopping condition, calculating a final mud weight for the planned wellbore based on the updated CCP, and conditioning a drilling mud to the final mud weight, using a mud system.

20 Claims, 8 Drawing Sheets

(51) Int. Cl.
*E21B 47/022* (2012.01)
*E21B 49/00* (2006.01)

(56) References Cited

U.S. PATENT DOCUMENTS

| | | | | |
|---|---|---|---|---|
| 10,837,279 | B2 * | 11/2020 | Han | G01V 1/282 |
| 11,255,184 | B1 * | 2/2022 | Xia | E21B 43/26 |
| 2003/0139916 | A1 | 7/2003 | Choe et al. | |
| 2010/0121623 | A1 | 5/2010 | Yogeswaren | |
| 2012/0097450 | A1 | 4/2012 | Wessling et al. | |
| 2014/0032192 | A1 | 1/2014 | Zamora et al. | |
| 2015/0055438 | A1 * | 2/2015 | Yan | G01V 1/282 367/73 |
| 2017/0097444 | A1 | 4/2017 | Shen et al. | |
| 2020/0224531 | A1 * | 7/2020 | Yan | E21B 41/0092 |
| 2021/0017857 | A1 * | 1/2021 | Khan | E21B 49/003 |
| 2021/0332690 | A1 | 10/2021 | Stishenko et al. | |

OTHER PUBLICATIONS

Kamgue Lenwoue, A. R. et al., "Wellbore Stability Analysis using an Elasto-Plastic Mogi-Coulomb Model"; Proceedings of the 53rd U.S. Rock Mechanics/Geomechanics Symposium; Paper No. ARMA-2019-0091; Jun. 23, 2019 (10 pages).

Abbas, Ahmed K. et al., "Wellbore Trajectory Optimization Using Rate of Penetration and Wellbore Stability Analysis"; Proceedings of the SPE International Heavy Oil Conference and Exhibition; Paper No. SPE-193755-MS; pp. 1-11; Dec. 10, 2018 (11 pages).

Hoseinpour, Masoud et al., "Determination of the mud weight window, optimum drilling trajectory, and wellbore stability using geomechanical parameters in one of the Iranian hydrocarbon reservoirs"; Journal of Petroleum Exploration and Production Technology; vol. 12, Issue 1; pp. 63-82; Jan. 2022 (20 pages).

* cited by examiner

QUANTIFICATION AND MINIMIZATION OF WELLBORE BREAKOUTS IN UNDERBALANCED DRILLING

BACKGROUND

In the oil and gas industry, when compared to conventional drilling, underbalanced drilling is known to maximize hydrocarbon recovery and reduce drilling issues such as differential sticking and lost circulation; however, drilling underbalance increases likelihood of wellbore instability. To mitigate drilling risks, once a hydrocarbon target is identified, teams of geoscientists or engineers will develop a set of properties regarding a subsurface to be penetrated in order to reach the hydrocarbon target. This set of properties may be used to model wellbore trajectories and determine drilling parameters that reduce the risk of wellbore stability issues, such as wellbore breakouts.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, in one aspect, embodiments disclosed herein relate to methods for quantifying and minimizing wellbore breakouts. The methods include obtaining a mechanical earth model (MEM) for a subterranean region, where the subterranean region comprises a location for a planned wellbore, determining a critical collapse pressure (CCP) for the planned wellbore using an inclination angle and the MEM, and determining an initial mud weight based, at least in part, on the CCP. The methods also include generating a breakout analysis using the initial mud weight, the MEM and a numerical modeling algorithm and, iteratively, or recursively, until a stopping condition is met, updating the inclination angle of the planned wellbore, updating the CCP based, at least in part, on the updated inclination angle and the MEM, and updating the breakout analysis using, at least in part, the initial mud weight, the updated CCP, the MEM, and the numerical modeling algorithm, where the breakout analysis includes a breakout depth. The methods further include selecting the updated CCP based, at least in part, on the updated inclination angle that meets the stopping condition, calculating a final mud weight for the planned wellbore based, at least in part, on the updated CCP, and conditioning a drilling mud to the final mud weight, using a mud system.

In general, in one aspect, embodiments disclosed herein relate to a non-transitory computer readable medium storing a set of instructions stored thereon that, when executed by a processor, performs steps that include receiving a mechanical earth model (MEM) for a subterranean region, where the subterranean region comprises a location for a planned wellbore, determining a critical collapse pressure (CCP) for the planned wellbore using an inclination angle and the MEM, and determining an initial mud weight based, at least in part, on the CCP. The steps also include generating a breakout analysis using the initial mud weight, the MEM and a numerical modeling algorithm, iteratively, or recursively, until a stopping condition is met, updating the inclination angle of the planned wellbore, updating the CCP based, at least in part, on the updated inclination angle and the MEM, and updating the breakout analysis using, at least in part, the initial mud weight, the updated CCP, the MEM, and the numerical modeling algorithm, where the breakout analysis comprises a breakout depth. The steps further include selecting the updated CCP based, at least in part, on the updated inclination angle that meets the stopping condition, calculating a final mud weight for the planned wellbore based, at least in part, on the updated CCP, and conditioning a drilling mud to the final mud weight, using a mud system.

In general, in one aspect, embodiments disclosed herein relate to a system for quantifying and minimizing wellbore breakouts. The system includes a computer processor configured to receive a mechanical earth model (MEM) for a subterranean region, where the subterranean region comprises a location for a planned wellbore, determine a critical collapse pressure (CCP) for the planned wellbore using an inclination angle and the MEM, determine an initial mud weight based, at least in part, on the CCP, and generate a breakout analysis using the initial mud weight, the MEM and a numerical modeling algorithm. The computer processor is also configured to iteratively, or recursively, until a stopping condition is met, update the inclination angle of the planned wellbore, update the CCP based, at least in part, on the updated inclination angle and the MEM, and update the breakout analysis using, at least in part, the initial mud weight, the updated CCP, the MEM, and the numerical modeling algorithm, where the breakout analysis includes a breakout depth. The computer processor is further configured to select the updated CCP based, at least in part, on the updated inclination angle that meets the stopping condition, and calculate a final mud weight for the planned wellbore based, at least in part, on the updated CCP. The system also includes a mud system configured to condition a drilling mud to the final mud weight.

Other aspects and advantages of the claimed subject matter will be apparent from the following description and the appended claims.

DETAILED DESCRIPTION

Figure 1:
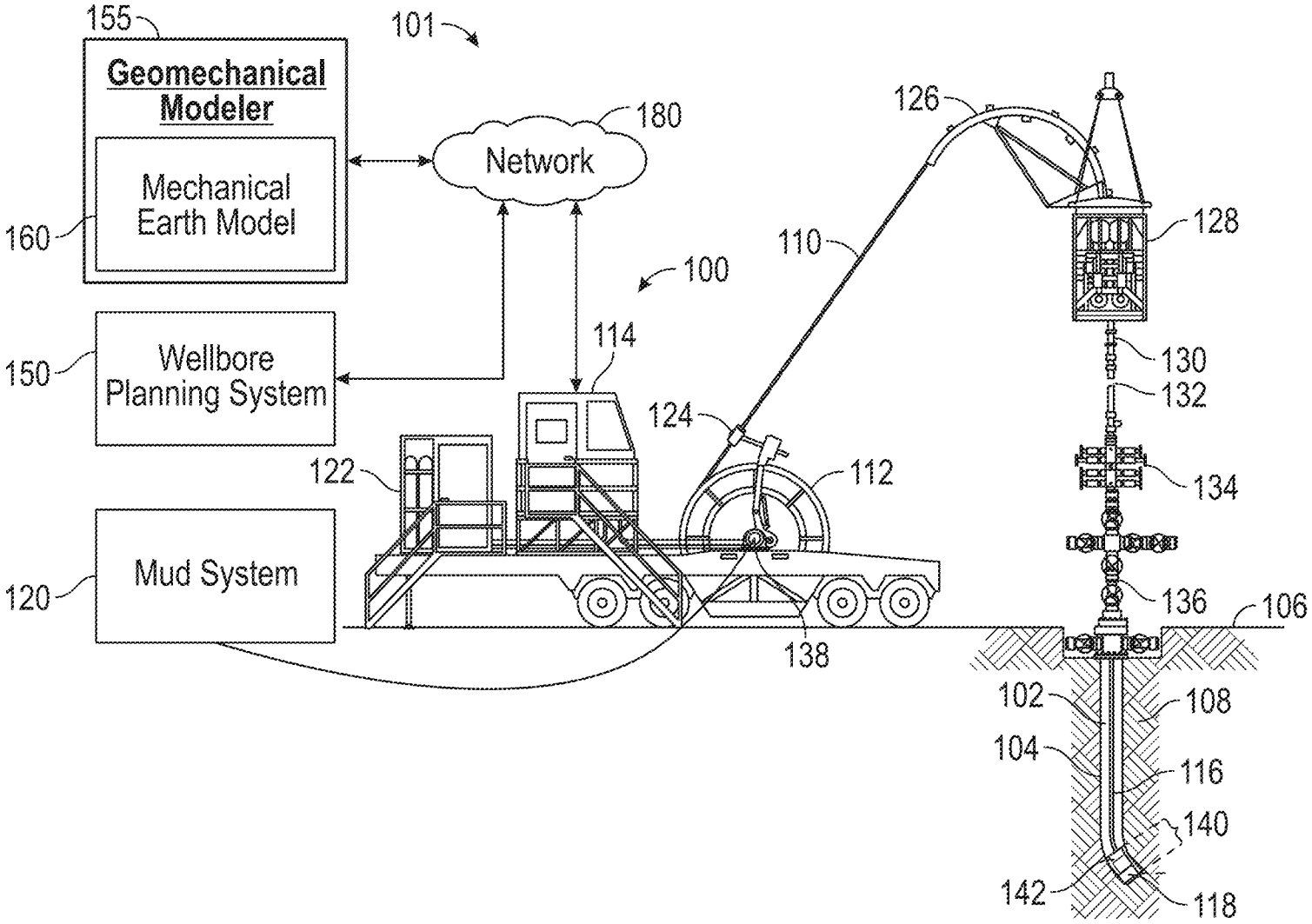
FIG. 1 shows an example of a drilling system in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In the following description of FIGS. 1-9, any component described regarding a figure, in various embodiments disclosed herein, may be equivalent to one or more like-named components described with regard to any other figure. For brevity, descriptions of these components will not be repeated regarding each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure.

It is to be understood that the singular forms "a," "an," and "the" include plural referents unless the context clearly dictates otherwise. Thus, for example, reference to "a wellbore" includes reference to one or more of such wellbores.

Terms such as "approximately," "substantially," etc., mean that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

It is to be understood that one or more of the steps shown in the flowcharts may be omitted, repeated, and/or performed in a different order than the order shown. Accordingly, the scope disclosed herein should not be considered limited to the specific arrangement of steps shown in the flowcharts.

Although multiple dependent claims may not be introduced, it would be apparent to one of ordinary skill that the subject matter of the dependent claims directed to one or more embodiments may be combined with other dependent claims.

Wellbore integrity issues are typically due to the shear failure or tensile failure of the rock formation being drilled. To ensure wellbore integrity while drilling, the geomechanical analysis of wellbore fractures and wellbore breakouts may be conducted to estimate drilling fluid densities (i.e., drilling mud weights). An appropriate drilling mud weight is a crucial factor to reduce the chances of wellbore failure. Currently, wellbore failures such as wellbore breakouts may be quantified using well log caliper measurements during or after drilling.

Disclosed are embodiments that allow for the quantification and minimization of wellbore breakouts using 2D numerical modeling before drilling. Wellbore simulations may be produced by integrating a geomechanical model with numerical modeling algorithms. The simulations allow for the observation and quantification of wellbore breakouts in various drilling scenarios. The numerical modeling results can be used to quantify wellbore breakouts as a function of variables such as the wellbore inclination angle and the drilling mud weight. A drilling mud is conditioned based on a final mud weight calculation for use in wellbore drilling Further, methods are disclosed for drilling a planned wellbore for a subterranean region based on variables that minimize wellbore breakouts.

The terms "borehole" and "wellbore" are often used synonymously, although the wellbore may refer to the drilled hole including the cased portion, whereas the borehole may not include the casing and may refer to the diameter of the open hole itself. However, throughout the present disclosure, the terms wellbore and borehole are used synonymously.

FIG. 1 shows an example of a drilling system in accordance with one or more embodiments. The drilling system (100), located at a wellsite (101), may be used to drill a wellbore (102) having a wellbore wall (104) and extending below the surface (106) of the earth, into a target zone of a formation (108), such as a hydrocarbon reservoir (not shown). In particular, FIG. 1 shows an example of a coiled tubing drilling system, also referred to as a "coiled tubing unit". Coiled tubing (CT) (110) refers to a long, continuous length of steel pipe typically wound on a spool or a "CT reel" (112). In the example shown, the CT unit is trailer-mounted for a land operation; however, CT drilling may also be performed in an offshore environment. The CT drilling system may comprise a control system located in the control cabin (114), mud system (120), a CT string (116), and a drill bit (118) for use in boring a wellbore (102) into the formation (108).

The control system may comprise hardware or software for managing drilling operations or maintenance operations. For example, the control system may include one or more programmable logic controllers (PLCs) comprising hardware or software with functionality to control one or more processes performed by the drilling system (100). Specifically, a programmable logic controller may control valve states, fluid levels, coiled tubing tension or pressures, warning alarms, or pressure releases throughout a drilling rig. In accordance with some embodiments, the programmable logic controller may be a ruggedized computer system with functionality to withstand vibrations, extreme, wet conditions, or dusty conditions, for example, around a drilling rig. The term "control system" refers broadly to systems that effect control including, for example and without limitation, a drilling operation control system that is used to operate and control the equipment, a drilling data acquisition and monitoring system that is used to acquire drilling process and equipment data and to monitor the operation of the drilling process, and/or a drilling interpretation software system that is used to analyze and understand drilling events and progress.

Prior to the commencement of drilling, a wellbore plan may be generated. The wellbore plan may include a starting surface location of the wellbore (102), or a subsurface location within an existing wellbore, from which the wellbore may be drilled. Further, the wellbore plan may include a terminal location that may intersect with the targeted hydrocarbon bearing formation. Accordingly, the planned wellbore may follow a wellbore path that extends from the starting location to the terminal location. In some embodiments, the wellbore path may intersect a previously located hydrocarbon reservoir.

Typically, the wellbore plan is generated based on best available information from geomechanical models using encapsulating subterranean stress conditions, the trajectory of any existing wellbores (which it may be desirable to avoid), and the existence of other drilling hazards, such as shallow gas pockets, over-pressure zones, and active fault planes. A geomechanical modeler (155) may be used to construct the geomechanical model using information from a mechanical earth model (MEM) (160). An MEM (160) is a collection of measurements that represent the mechanical properties of rocks, stresses, pressures, and temperatures acting on the rocks at certain depths.

The wellbore plan may include wellbore geometry information such as wellbore diameter and inclination angle. If casing is used, the wellbore plan may include casing type or casing depths. Furthermore, the wellbore plan may consider other engineering constraints such as the maximum wellbore curvature ("dog-log") that a CT string (116) or drillstring may tolerate and the maximum torque and drag values that the wellbore drilling system may tolerate.

A wellbore planning system (150) may be used to generate the wellbore plan. The wellbore planning system (150) may comprise one or more computer processors in communication with computer memory containing the geophysical and geomechanical models, information relating to drilling hazards, and the constraints imposed by the limitations of the CT string (116) or drillstring and the wellbore drilling system (100). The wellbore planning system (150) may further include dedicated software to determine the planned wellbore path and associated drilling parameters, such as the planned wellbore diameter, the location of planned changes of the wellbore diameter, the planned depths at which casing (if used) will be inserted to support the wellbore and to prevent formation fluids entering the wellbore, and the drilling mud weights (densities) and types that may be used during drilling the wellbore. The wellbore planning system (150) may be implemented on one or more computer systems such as the one shown in FIG. 9, discussed later.

A wellbore planning system (150) may transmit wellbore plan information over a network (180) to the control system. The network (180) may include the Internet, ethernet, satellite, or a local area network (LAN), without limiting the scope of the invention. The wellbore planning system (150) and geomechanical modeler (155) may be located in an office, at the wellsite (101), or at a location some distance from the wellsite (101).

During a CT drilling operation, the CT (110) may be deployed downhole by spooling the pipe off the CT reel (112) using a drive system powered by a power unit (122). The power unit (122) may use a diesel engine to power hydraulic pumps used to drive hydraulic motors used in the CT drilling operation. The power unit (122) may include hydraulic accumulators to provide emergency back-up power in case of power unit failure or power unit shut down, and is connected to each component of the CT drilling operation requiring hydraulic power via hydraulic hoses.

The CT (110) is spooled upwards from the CT reel (112), through the spooler head (124) and a gooseneck (126), which may be equipped with rollers, to guide the CT (110) into an injector unit (128), vertically. The gooseneck (126) may also serve to ensure the CT (110) is not exposed to excessive bending forces between the CT reel (112) unit and the injector unit (128), and thus the gooseneck (126) diameter may correspond to the CT reel (112) diameter. The drive system is used to maintain constant tension in the CT (110), while the spooler head (124), synchronized with the rotation of the CT reel (112), moves across the CT reel (112) to ensure the CT (110) is properly coiled upon itself. As CT (110) passes through the spooler head (124), frictional contact of the pipe on measuring wheels causes the measuring wheels to turn. The measuring wheels may be connected to a "depth odometer," which may be used to measure the length of CT (110) being spooled. Alternatively, the depth measurement may be taken electronically. At this stage, the CT (110) may also be lubricated with an oil-based corrosion inhibitor using a spraying system.

The CT (110) may then pass through the injector unit (128) where it is straightened with the goal of being pushed into the wellbore (102). The injector unit (128) may be suspended from a tower structure or a crane (not shown). The injector unit (128) may transfer force to inject, retract, or hold the CT (110) in place and may be hydraulically driven by one or more motors using a drive chain system, of which the chain assembly grips the CT (110). The hydraulic motors may be equipped with brakes to hold the CT (110) in case of a failure in the hydraulic system. Measurement devices may be bolted to the injector unit assembly, such as a weight indicator (to measure tension or compression in the CT (110)), or a depth system sensor (to measure the depth and speed of the CT (110)).

Below the injector unit (128), a stripper assembly (130) provides an external pressure barrier by creating a seal around the CT (110). There may be more than one stripper mounted in the assembly to be used as a back-up pressure barrier. Next, a lubricator (132) may be fitted between the stripper assembly (130) and a blowout preventor (BOP) (134). The CT (110) is lubricated with an oil-based lubricant to reduce friction and prolong the life of the stripper seal before passing through the BOP (134).

A BOP (134) is typically fitted to the wellhead (136) to protect the operation and environment from unplanned wellbore fluid releases. A common BOP (134) setup is a "quad BOP," which is a series of four pairs of ram actuators, each used for different purposes. For example, a blind ram may be used to seal the wellbore at the surface, a shear ram may be used to shear (or cut) the CT (110), a slip ram may be used to hold the CT (110) in place, and a pipe ram may be used to seal the CT annulus below the aforementioned rams. More than one type of BOP (134) may be required for a drilling operation and the entire BOP system may be powered by a BOP accumulator unit.

Below the BOP (134), a cable valve may be installed. The BOP (134) and cable valve must be opened to allow the CT (110) to enter the wellhead (136). To prevent strain on the wellhead (136) due to the combined weight of the injector unit assembly and the BOP (134), this equipment may be mounted on a support frame or a crane (not shown). If a crane is used, the crane load may be continuously monitored throughout the operation.

The drilling process may be controlled and monitored from the control cabin (114). A coiled tubing operator located inside the control cabin (114) may control all equipment using hydraulic pressure control valves. A main control system may regulate the direction and speed of the injector, the CT reel (112) and spooling system. A CT operator may also monitor recording instrument measurements such as pressure gauges (e.g., a BOP pressure gauge), a tubing depth meter (from the depth system sensor), tubing load (from the weight indicator), and power unit (122) temperature.

Drilling fluid, or drilling mud (herein also called "mud,") may be stored in a mud tank (or mud pit). While drilling, the mud system (120), equipped with at least one pump, may pump the mud from the mud tank into the hub (138) of the CT reel (112), to which the inner end of the CT (110) is connected. A high-pressure swivel joint may be used to pump fluids through the CT (110) as it is stationary or being deployed.

The mud may flow down the CT string (116) and exit through the bottom of the wellbore (102) via nozzles in the drill bit (118). The mud in the wellbore (102) then flows back up to the surface in an annular space between the CT string (116) and the wellbore (102), along with entrained drill cuttings. The mud and cuttings mixture is returned to the mud tank (or mud pit) to be re-circulated back into the CT (110). Typically, before re-circulating the mud, the cuttings are removed from the mud and the mud is reconditioned as necessary.

Drilling mud may serve various purposes, such as pressure equalization, removal of rock cuttings, or drill bit cooling and lubrication. The treatment and control ("conditioning") of drilling mud ensures that it has the correct properties for the specific drilling operation. Conditioning drilling mud may include the use of additives, the removal of sand or other solids, the removal of gas, or the addition of water. Inert gas, such as nitrogen, may also be injected at the hub (138), or may be mixed with drilling mud before injection to control the density of the mud. Inert gas may be used to prevent explosions, displace oxygen, or maintain low hydrostatic pressure in the wellbore.

In some embodiments, wire from a wire reel may be inserted into the CT (110) at the hub (138), where it runs through the length of the CT (110) and out through the bottom hole assembly (BHA) (140). The wire reel may include instruments such as a speedometer or a tension sensor. The speedometer may measure the rate at which the wire is being spooled into (or from) the CT reel (112). The control cabin (114) may receive transmitted data from the speedometer to harmonize the speed of the wire reel and the CT reel (112) when spooling or unspooling. Tension force may also be monitored from the control cabin (114). In addition, the wire reel may include a port to pump friction reducers inside the wire reel, such as grease, which may ease pulling of and reduce tension on the wire when traveling through the CT (110). In other embodiments, the wire may be used to transmit downhole measurements from the BHA (140) to the surface (106) in real-time.

To drill the wellbore (102), the BHA (140) may be attached to the end of the CT (110), also referred to as the "CT string" (116), via a coiled tubing connector (142). The BHA (140) may include a drill bit (118) to cut into subsurface rock and a downhole motor such as a mud motor. The force of the drilling mud being pumped through the mud motor may be converted to provide rotational force to the drill bit (118) in order to break rock in the formation (108). Drilling deviated or horizontal wellbores may require specialized drill bits or drill assemblies.

The BHA (140) may further include components such as a steering assembly (for directional drilling), drill collars, stabilizers, logging-while-drilling (LWD) tools, measurement-while-drilling (MWD) tools, and various other downhole tools without departing from the scope of the present disclosure. MWD tools may include sensors and hardware to measure downhole drilling parameters, such as the azimuth and inclination of the drill bit (118), the weight-on-bit, and the torque. The LWD measurements may include sensors, such as resistivity, gamma ray, and neutron density sensors, to characterize the rock formation surrounding the wellbore. Both MWD and LWD measurements may be transmitted to the surface (106) using any suitable telemetry system, such as mud-pulse or wired CT, known in the art.

A wellbore drilling system (100), such as the CT drilling system shown, may control at least a portion of a drilling operation by providing controls to various components of the drilling operation. In one or more embodiments, the system may receive data from one or more sensors arranged to measure controllable parameters of the drilling operation. As a non-limiting example, sensors may be arranged to measure WOB (weight on bit), RPM (drill rotational speed), GPM (flow rate of the mud pumps), and ROP (rate of penetration of the drilling operation). Each sensor may be positioned or configured to measure a desired physical stimulus. Drilling may be considered complete when a target zone is reached, or the presence of hydrocarbons is established.

While the example in FIG. 1 shows a CT drilling operation, the drilling of a wellbore may be carried out using a conventional drilling system or any other drilling system known in the art. A CT drilling system may be beneficial in various drilling circumstances or for economic or safety reasons. CT drilling may be used to drill directional or non-directional wellbores, and typically uses a higher bit rotational speeds and lower WOB than conventional drilling systems. As a result of the CT drilling setup, the amount of drilling fluids invading the formation (108) may be reduced, which may minimize reservoir damage while drilling. CT drilling may be used in overbalanced or underbalanced drilling, and may commonly be implemented in underbalanced drilling, where the hydrostatic pressure of the fluid column drops below reservoir pressure, allowing fluids to flow more freely.

Underbalanced drilling (UBD) refers to a drilling procedure where the pressure in the wellbore is intentionally kept lower than the pore pressure of the formation (108) being drilled. The pressure in the wellbore (102) may be controlled by using a lower density drilling mud (i.e., a lower "mud weight"). Injecting and mixing an inert gas, such as dry air, nitrogen, or natural gas, into the drilling mud may be used to lower the drilling mud density. Underbalanced CT drilling may allow for continuous drilling and pumping which may increase the drill rate, which is the speed at which the drill bit (118) breaks the formation (108) rock.

It is known in the art that while UBD may maximize hydrocarbon recovery and minimize pressure-related drilling issues such as differential sticking and lost circulation, the instability of the wellbore may also increase, and excessive borehole erosion may occur. That is, one of the most critical problems associated with UBD is the increased likelihood of developing wellbore failures such as erosion or wellbore "breakouts." A wellbore breakout is a type of rock failure around the wellbore wall (104) and may occur when the stress anisotropy surpasses the shear strength limit of the rock.

Rock strength may be quantified in terms of tensile strength and compressive strength. The tensile strength of rock is defined as the pulling force required to rupture a rock sample, divided by the sample's cross-sectional surface area. The compressive strength of rock may be defined as the capacity of the rock to withstand a load without failure; that is, the force of the load, divided by the sample's cross-sectional surface area. The relationship between the compressive and tensile strength of rock depends on rock type.

Drilling a borehole causes changes in the local in situ rock stress in and near the wellbore, which may lead to rock failure. Stress is a physical quantity of measuring the force of one particle applied to another particle of a given material or object (e.g., rock). Normal rock stress is stress that is perpendicular to the rock surface, whereas shear rock stress is parallel to the rock surface. Circumferential stress refers to the force over an area exerted circumferentially, e.g., the stress perpendicular to the axis and radius of the wellbore. Wellbore breakouts may occur when the circumferential stress around the wellbore exceeds the compressive rock strength. Wellbore breakouts are typically formed in parallel to the minimum horizontal stress ($S_{hmin}$). Wellbore fractures, or drilling-induced tension fractures, may occur when the circumferential stress exceeds the tensile strength of the wellbore wall (104), and are typically oriented parallel to the maximum horizontal stress ($S_{Hmax}$).

Figure 2:
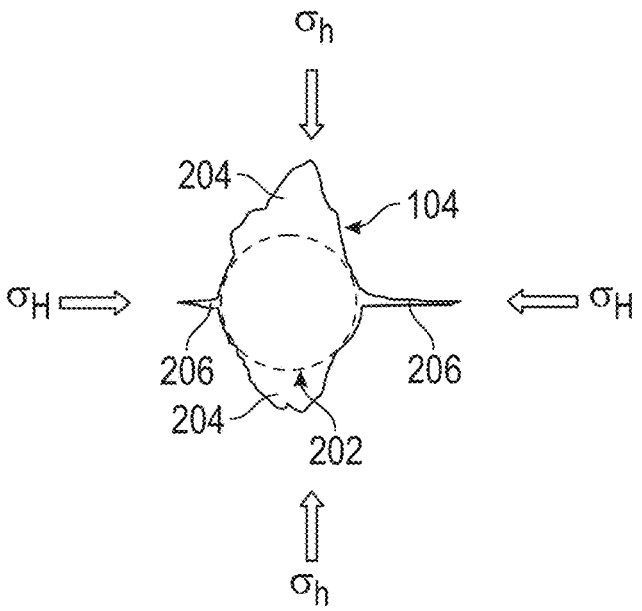
FIG. 2 shows a schematic cross-section of examples of wellbore failure, in accordance with one or more embodiments.

FIG. 2 shows a schematic cross-section of examples of wellbore failure, in accordance with one or more embodiments. The expected shape of the wellbore wall (104) is controlled by the bit size (202) of the drill bit (118); however, in FIG. 2, wellbore breakouts (204) have occurred on both sides of the wellbore in the direction of $S_{hmin}$ or o-h. In the perpendicular direction, the wellbore has failed producing fractures (206) on both sides of the wellbore, along the $S_{Hmax}$ or $\sigma_H$ axis. Further, wellbore breakouts (204) may occur 180 degrees apart and may be identified using a range of well logging tools.

Various resistivity and acoustic imaging tools may be used to generate images of the wellbore wall (104). For example, an acoustic borehole televiewer is an ultrasonic well-logging tool used to image stress-induced wellbore breakouts. The televiewer scans the wellbore wall (104) using a rotating acoustic transducer that emits a focused beam pulse at a very high rate while rotating and moving vertically up the wellbore (102). Data may be interpreted and used to estimate angle, width, azimuth, and depth of stress-induced breakouts in the well. However, currently the only way to measure and quantify wellbore breakouts directly is by running and observing a caliper well log.

Figure 3:
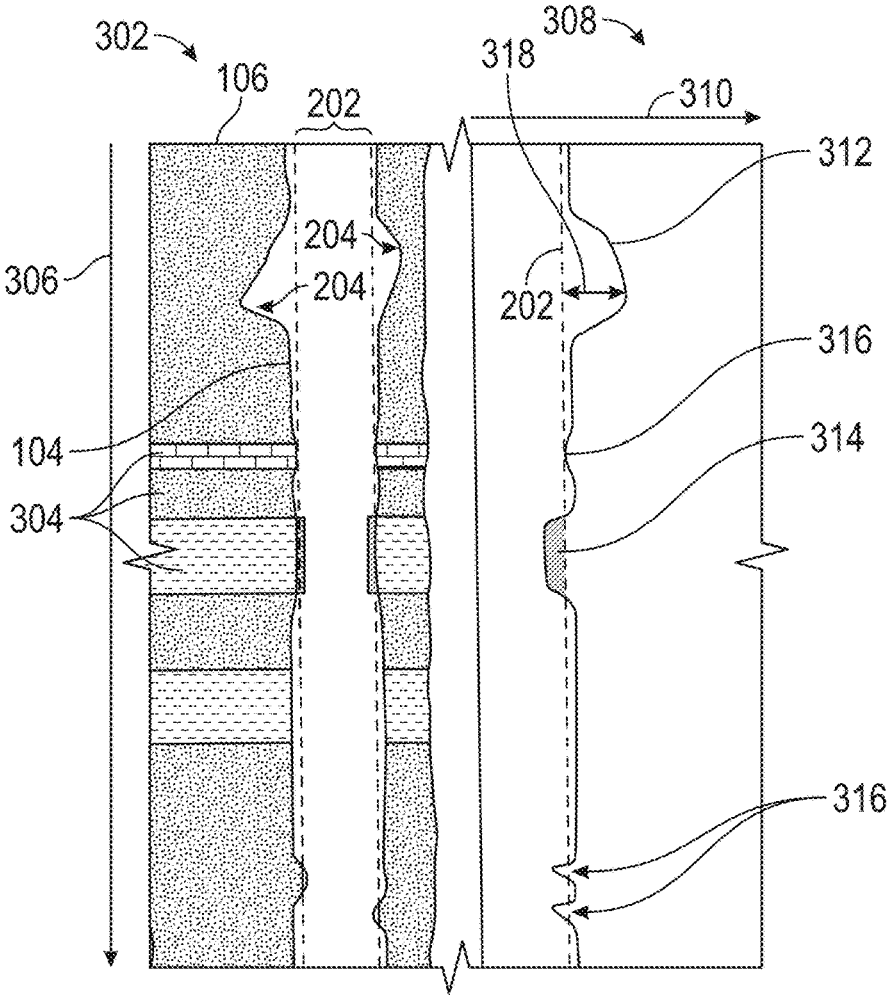
FIG. 3 shows an example of a cross-section of a drilled wellbore and its corresponding caliper log in accordance with one or more embodiments.

FIG. 3 shows an example of a cross-section of a drilled wellbore (302) and its corresponding caliper log (308) in accordance with one or more embodiments. A caliper log is a type of well log that provides a continuous measurement of the size and shape of the wellbore (102) with depth. The caliper tool generates the caliper log using a plurality of articulated arms that apply pressure against the wellbore wall (104). The caliper tool is typically lowered into the wellbore (102) and measurements begin as it is pulled out of the wellbore (102). As the tool is pulled out of the wellbore (102), the plurality of arms each experience changes in resistance. These changes in resistance are recorded against wellbore depth, then translated to changes in wellbore diameter based on a calibration of the tool.

The cross-section of the drilled wellbore (302) in FIG. 3 shows the wellbore (102) penetrating the surface (106) of the earth through various formation layers (304), with the vertical axis (306) representing wellbore depth. The distance between the dotted lines indicates the bit size (202) of the drill bit (118) used to drill the wellbore (102). A visual comparison of the bit size (202) diameter and the wellbore wall (104) diameter reveals wellbore breakouts (204), i.e., where the wellbore wall (104) has failed due to drilling.

The caliper log (308) reflects the changes in diameter seen in the cross-section of the drilled wellbore (302). The horizontal axis (310) represents the wellbore diameter (typically measured in inches or centimeters). The caliper measurement (312) is the diameter of the wellbore wall (104) and varies with wellbore depth. A caliper measurement (312) that is significantly larger than the bit size (202) may indicate wellbore breakouts (204), whereas areas a caliper measurement (312) significantly smaller than the bit size (202) may indicate a build-up of mud cake (314) or a "tight spot" (316). When the caliper measurement (312) is the close to or the same as the bit size (202), it is considered to be "on gauge" (316). A wellbore breakout (204) may be quantified by measuring the breakout depth (318); that is, by subtracting the bit size (202) from the caliper measurement (312).

As previously discussed, wellbore stability is dependent on factors such as in situ rock stress, and rock strength parameters. However, some factors affecting wellbore stability may be controlled, such as wellbore inclination, wellbore azimuth and drilling mud weight.

Figure 4:
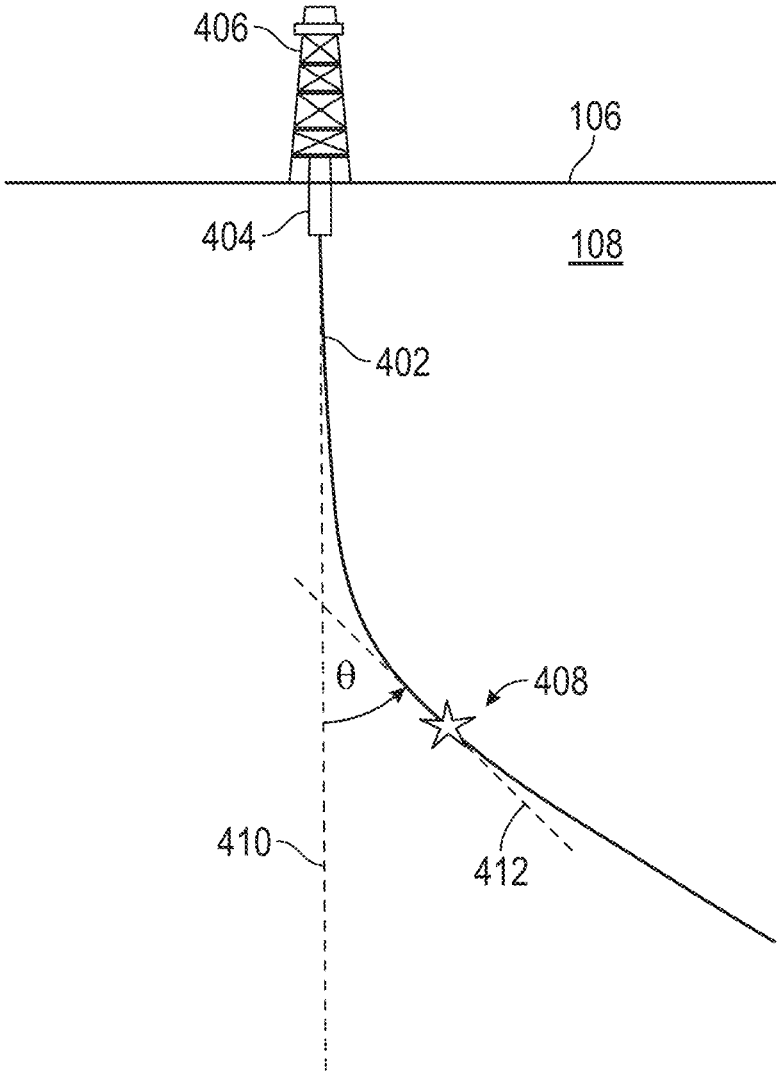
FIG. 4 depicts a cross-section of a wellbore path in accordance with one or more embodiments.

FIG. 4 depicts a cross-section of a wellbore path in accordance with one or more embodiments. The wellbore path (402) is shown extending from the surface casing (404) below a drill rig (406) on the surface (106) of the earth. The wellbore path (402) penetrates the formation (108) and deviates slightly. The inclination angle (θ) of the wellbore at a given location (408) is the angle between the vertical axis (410) (i.e., the true vertical depth (TVD) below the surface (106)) and the line tangential (412) to the wellbore path (402) at the given wellbore location (408). A wellbore with an inclination angle (θ) of 0 degrees is considered a vertical wellbore, and a wellbore with an inclination angle (θ) of 90 degrees is considered a horizontal wellbore. An inclination angle (θ) greater than 90 degrees is considered "drilling up". In some embodiments, an increase in the inclination angle (θ) may widen the safe mud weight window, which may reduce the risk of wellbore breakout or collapse.

The mud weight is the density (mass per unit volume) of the drilling mud used to drill the wellbore (102). The mud weight helps to control the hydrostatic pressure of the formation (108) around a wellbore (102), which can influence fluid flow and serves to stabilize the wellbore (102) while drilling. That is, the mud weight used in drilling may translate to the pressure inside the wellbore (102) and may be referred to as "mud pressure." Typically, a mud weight that maintains wellbore pressure between normal (hydrostatic) and fracture pressure is used. For example, if the mud weight is too small, the pressure inside the wellbore may be too low to hold back formation pressure, leading to wellbore collapse. However, if the mud weight is too large, the pressure inside the wellbore (102) may be too high, causing formation (108) damage such as drilling induced fractures or wellbore fractures (206). In addition to formation damage, heavier mud weights may result in slower ROP, or drilling fluid loss to the formation. Therefore, it is vital to choose an appropriate mud weight range, or "mud weight window," for drilling operations.

Figure 5:
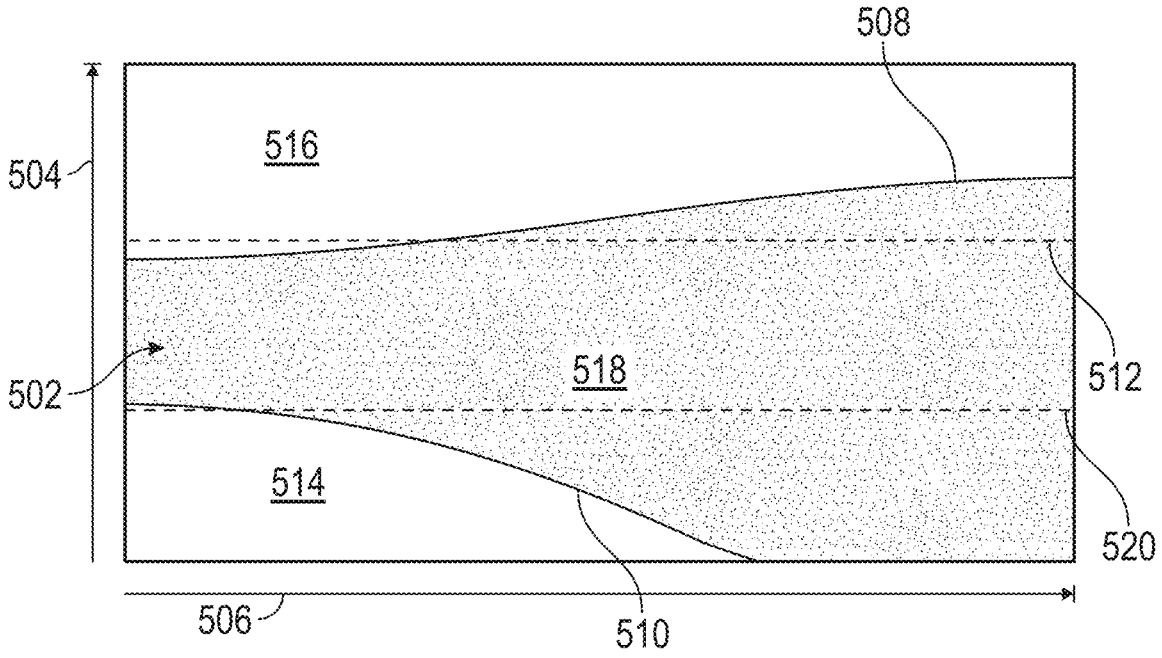
FIG. 5 shows a plot of a safe mud weight window for a given depth in accordance with one or more embodiments.

FIG. 5 shows a plot of a safe mud weight window for a given depth in accordance with one or more embodiments. A safe mud weight window (502) is the range of equivalent densities or pressures for which the wellbore will remain stable during drilling. Typically, the safe mud weight window (502) varies with wellbore depth. In FIG. 5, the vertical axis (504) represents increasing drilling mud weight, measured in pounds per cubic feet (pcf), while the horizontal axis (506) represents increasing wellbore inclination angle (θ), from 0 to 90 degrees. The safe mud weight window (502) for a given depth is constrained by an upper limit, the fracture pressure (508), and a lower limit, the critical collapse pressure (CCP) (510). If the mud pressure falls below the CCP (510), also referred to as the breakout pressure, the wellbore (102) may collapse, or wellbore breakout (204) may occur. On the other hand, if the mud pressure increases above the minimum horizontal stress, $S_{hmin}$, (512), the drilling mud may begin to invade the formation (108) resulting in mud loss. If the pressure inside the wellbore (102) increases still and surpasses the fracture pressure (508), the wellbore (102) may fracture.

Further, in FIG. 5, as the wellbore inclination angle (θ) (i.e., the horizontal axis (506)) increases for the given depth, it should be noted that the fracture pressure (508) increases and the CCP (510) decreases, widening the safe mud weight window (502). At the given depth, for inclination angles (θ) between 0 and 90 degrees, the collapse region (514) is defined as the area under the CCP (510) curve, while the fracture region (516) is defined as the area above the fracture pressure (508) curve. The stable region (518), or safe mud weight window (502), is the area between the two curves indicated by the shaded area. The pore pressure (520) of the formation (108), which remains constant with variation in inclination angle (θ), may be used as a guide when a low mud weight is desired, such as in UBD as previously discussed.

There exist multiple methods of calculating a safe mud weight window known to those ordinarily skilled in the art. For example, the Kirsch equation may be used to estimate fracture pressure (508) as a function of wellbore pressure, or the Mohr-Coulomb failure criterion may be used to estimate the conditions under which the wellbore may fail. Determining the safe mud weight window involves the analysis of various parameters, as discussed in FIG. 5, which may be determined through geomechanical modeling, using information from an MEM (160).

Each data point in the MEM (160) is referenced to its 3D spatial coordinates and time of sample collection. A fully developed MEM may include data such as rock elastic and strength properties, in situ stresses, or pore pressure information as a function of depth. The information required to build the MEM (160) may come from sources such as seismic data, well logs, or measurements of pressure, stress, or in situ temperature. Measurements from the physical analysis of well core samples, cuttings, or measurements from laboratory mechanical rock tests may also be included in the MEM (160). MEM data may be incorporated into a 3D geomechanical model.

A geomechanical modeler (155) may be used to model a reservoir at various times, such as the initial conditions of a reservoir, or to track rock deformation or failure during drilling or reservoir production. That is, before drilling, an MEM (160) may be used to conduct wellbore stability analyses, to be able to issue recommendations regarding to wellbore orientation (e.g., inclination angle (θ), or azimuth) or mud weights.

Calculating the safe mud weight window (502) may involve rock elasticity parameters such as Young's modulus and Poisson's ratio. Young's modulus refers to of the ability of the rock to withstand changes when under tension or compression in a lengthwise direction, and Poisson's ratio is used to measure the rock deformation in the perpendicular direction of the applied force. Other parameters such as the overburden stress gradient, $S_{hmin}$ and $S_{Hmax}$ gradients and azimuths, pore pressure, or rock strength parameters may be used in the determination of a safe mud weight window (502). Pre-drill calculations of safe mud weight windows typically further include drilling parameters such as borehole radius, TVD, wellbore inclination angle (θ), and wellbore azimuth.

Figure 6:
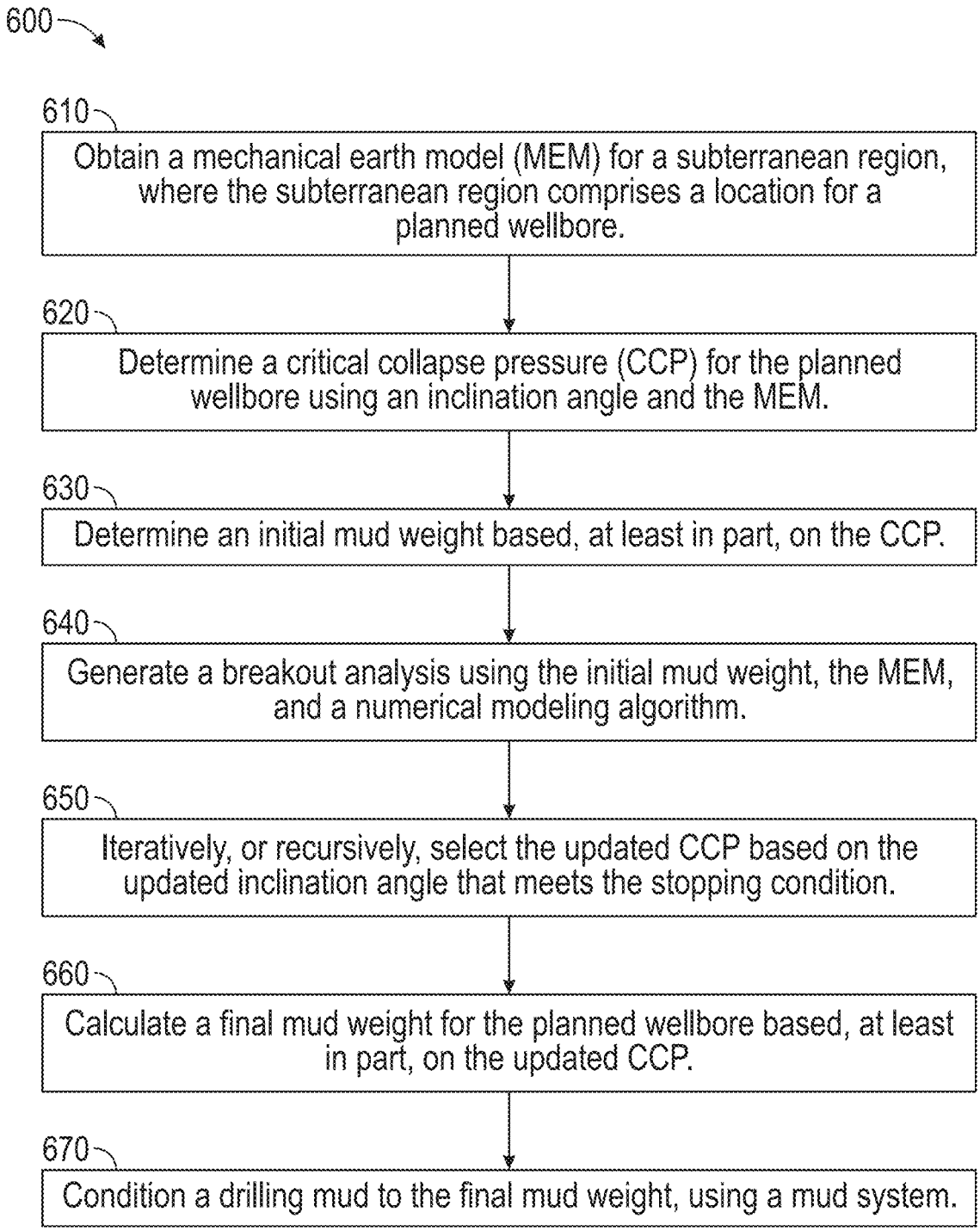
FIG. 6 shows a flowchart in accordance with one or more embodiments.

FIG. 6 shows a flowchart in accordance with one or more embodiments. In step 610 of flowchart (600), an MEM (160) is obtained for a subterranean region, where the subterranean region includes a location for a planned wellbore. The MEM may be a one-dimensional MEM. In some embodiments, the MEM (160) may be a two-dimensional (2D) fully developed MEM. The MEM (160) may be a pre-drill MEM (160) and may consist of in situ elastic properties of rock translated to stress magnitude values. The parameters of the planned wellbore may be determined using the wellbore planning system (150) as described in FIG. 1.

In step 620, in accordance with one or more embodiments, a CCP is determined for the planned wellbore, using an inclination angle and the MEM. In some embodiments, the inclination angle may be zero degrees. MEM properties, such as pore pressure, strength, or rock strength information may be used to determine the CCP. The CCP may be a function of shear failure criteria, such as Mohr-Coulomb, Mogi-Coulomb, Hoek-Brown, and may be determined using any method or software package known to those ordinarily skilled in the art.

In step 630, in accordance with one or more embodiments, an initial mud weight is determined based, at least in part, on the CCP. In some embodiments, determining the initial mud weight may include calculating a safe mud weight window based, at least in part, on the MEM (160) and selecting a low mud weight between a lower limit and an upper limit of the safe mud weight window. The safe mud weight window may lie between the CCP and the fracture pressure. That is, the lower limit may be the CCP and the upper limit may be the fracture pressure. The fracture pressure may be calculated using MEM properties. The initial mud weight may relate to a low mud pressure that is close to or the same as the CCP.

In step 640, in accordance with one or more embodiments, a breakout analysis is generated using the initial mud weight, the MEM, and a numerical modeling algorithm. In some embodiments, the breakout analysis may include a 2D finite element model. Using MEM information as well as wellbore drilling parameters, breakout analysis may be conducted to determine the behavior of the formation while drilling, specifically rock failure behavior. In some embodiments, the initial mud weight, in conjunction with MEM properties, may be supplied to a numerical modeling algorithm.

A numerical modeling algorithm may be used to observe and quantify wellbore breakouts (204) before drilling. Numerical modeling uses mathematical models to describe the physical conditions in geomechanical scenarios using numbers and equations. Numerical modeling methods, such as finite difference methods or finite element methods, may be used to approximate solutions to these equations. Further, numerical experiments may be performed using these models, producing results that may be interpreted in the context of geomechanical processes.

In some embodiments of step 640, the numerical modeling algorithm may run a 2D simulation of the planned wellbore to observe the effect of increasing the wellbore inclination angle on the number, type, and magnitude of wellbore failures. Results may be generated and analyzed for particular depths within the model. Results may include the breakout depth (318), the breakout location on the wellbore wall (104), and the wellbore depth at which the wellbore breakout (204) occurs. An example of breakout analysis is shown later, in FIG. 8.

In step 650, in accordance with one or more embodiments, the updated CCP is selected using an iterative or recursive method. The iterative or recursive method of step 650 is discussed further in FIG. 7.

Figure 7:
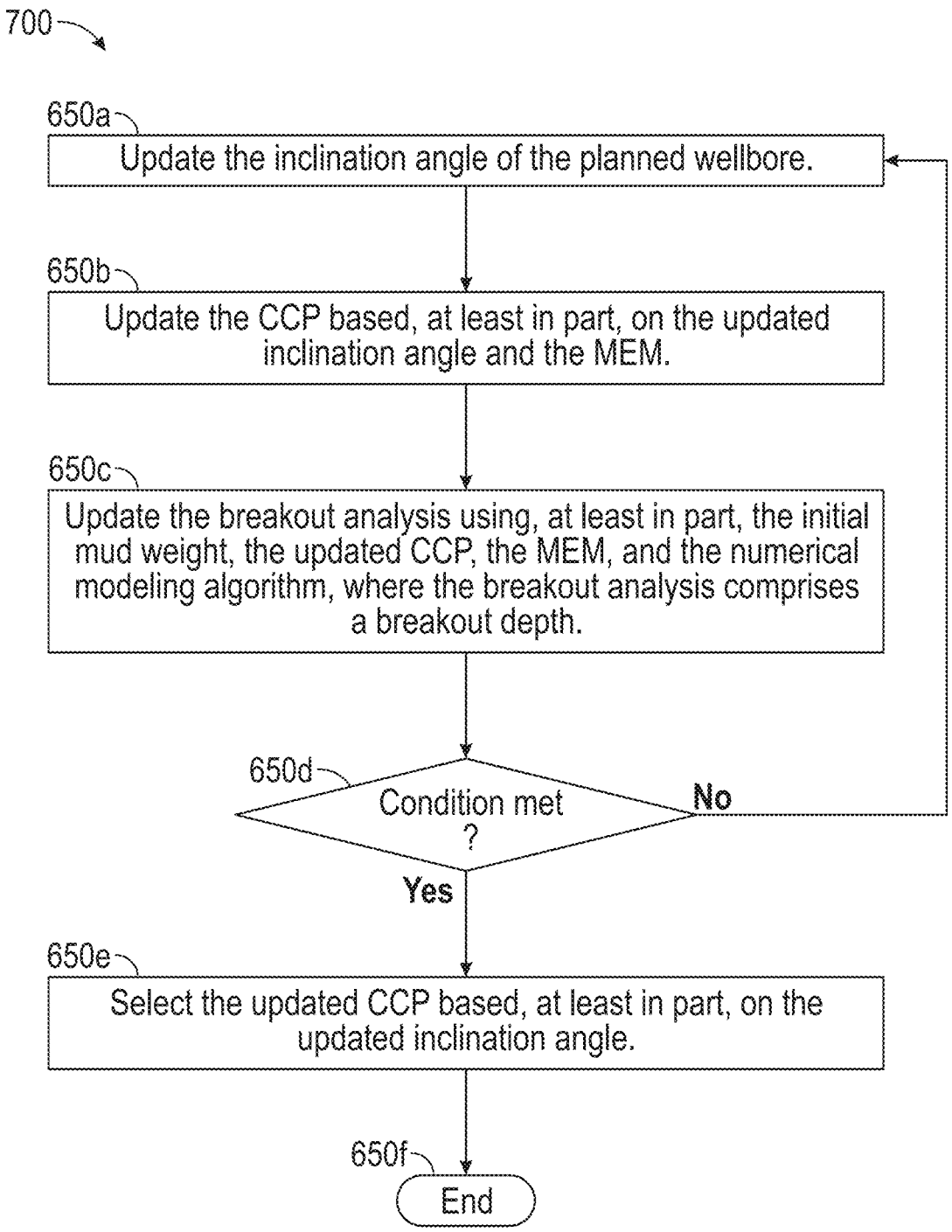
FIG. 7 shows a flowchart in accordance with one or more embodiments.

FIG. 7 shows a flowchart in accordance with one or more embodiments. In step 650*a* of flowchart (700), the inclination angle of the planned wellbore is updated. In some embodiments, the inclination angle may be increased by some increment, such as 5 degrees.

In step 650*b*, in accordance with one or more embodiments, the CCP is updated based, at least in part, on the updated inclination angle from step 650*a* and the MEM (160) from step 610 of flowchart (600). In some embodiments, the CCP may be updated using the same information and method used in step 620 of flowchart (600).

In step 650*c*, in accordance with one or more embodiments, the breakout analysis is updated, using, at least in part, the initial mud weight, the updated CCP, the MEM, and the numerical modeling algorithm. In some embodiments, the breakout analysis may be updated via numerical modeling using new parameters, such as the updated CCP, and may include a breakout depth (318).

In step 650*d*, a conditional test may be performed, in accordance with one or more embodiments. In some embodiments, the condition may include the breakout depth (318) from step 650*c* reaching a minimum value. That is, if the breakout depth (318) from step 650*c* is below a breakout depth threshold, the conditional test may be considered satisfied. Otherwise, if the breakout depth (318) from step 650*c* is larger than the breakout depth threshold, the condition is not satisfied.

If the condition in step 650*d* is not satisfied, the process returns to step 650*a* to begin another iteration, where the inclination angle of the planned wellbore is updated. Otherwise, if the condition in step 650*d* is satisfied, the process continues to step 650*e*, where, in accordance with one or more embodiments, the updated CCP is selected based, at least in part, on the updated inclination angle. That is, the selected updated CCP is the CCP used in the updated breakout analysis that generates the breakout depth (318) satisfying the condition in step 650*d*. Once the updated CCP is selected, the loop ends (650*f*) and continues to step 660 of flowchart (600).

Returning to flowchart (600), in step 660, in accordance with one or more embodiments, a final mud weight is calculated for the planned wellbore, based, at least in part, on the updated CCP. In some embodiments, calculating the final mud weight may include updating wellbore geometry information such as the updated inclination angle. Calculating the final mud weight may include calculating an updated safe mud weight window based on the updated CCP and updated inclination angle, using the MEM. The information or method used to calculate the final mud weight may be similar to those discussed in step 630.

In step 670, in accordance with one or more embodiments, a drilling mud is conditioned to the final mud weight, using a mud system (120). The drilling mud may be conditioned to meet a density requirement. The mud system (120) may mix drilling mud with various additives before circulation in a drilling operation.

In further embodiments, the final mud weight may be used, in part, to update a planned wellbore using the wellbore planning system (150). The wellbore (102) may follow a curved wellbore path, or a straight wellbore path. All or part of the wellbore path (402) may be vertical, and some wellbore paths may be deviated or have horizontal sections. The wellbore path (402) may be drilled by any drilling system known in the art, such as a conventional drilling system, or using the CT drilling system described in FIG. 1.

Figure 8:
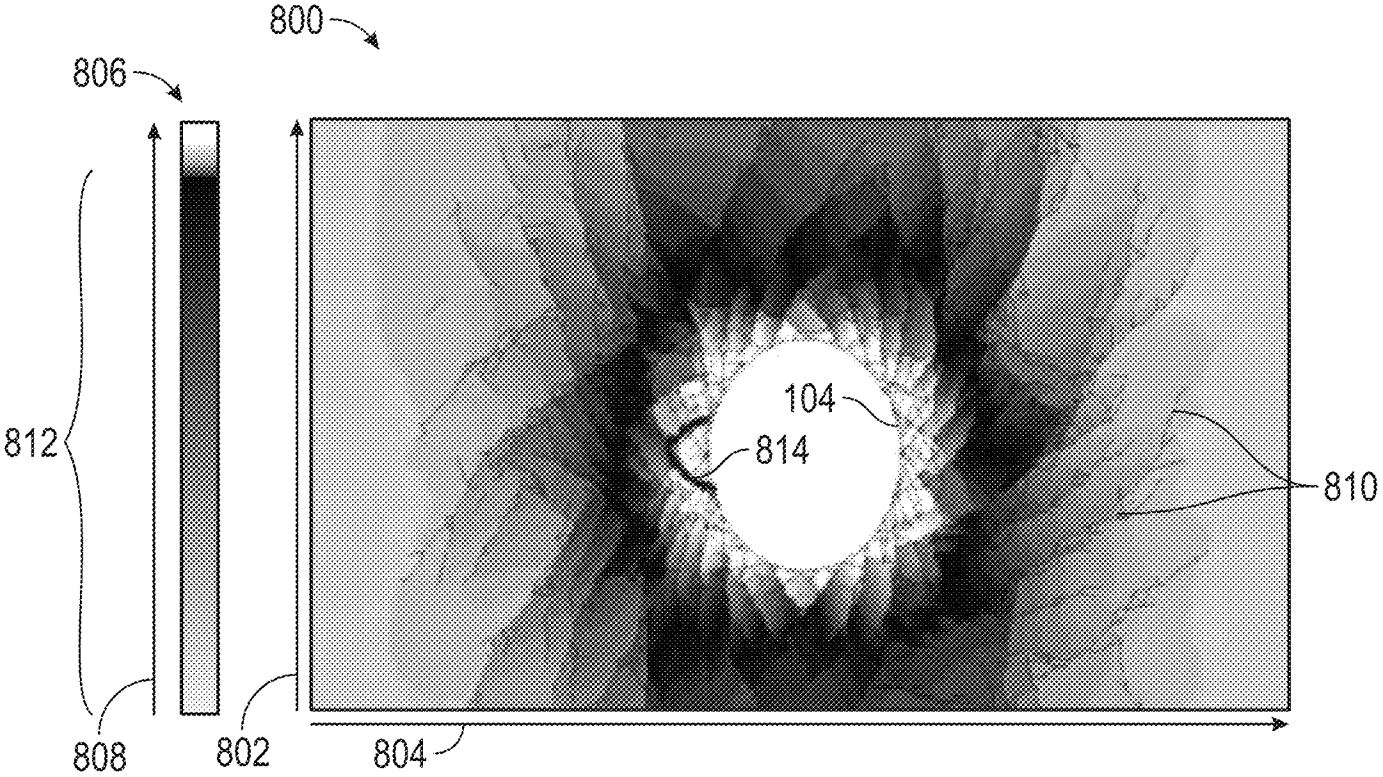
FIG. 8 shows an example of breakout analysis in accordance with one or more embodiments.

FIG. 8 shows an example of breakout analysis in accordance with one or more embodiments. The breakout analysis (800) shown is for a single depth and was completed by constructing a 2D finite element model. The vertical axis (802) represents a spatial coordinate increasing in one direction, for example a y-coordinate, while the horizontal axis (804) represents a spatial coordinate increasing in the perpendicular direction, such as an x-coordinate. The shades of gray represent a result from numerical modeling, specifically the main displacement, measured in meters, and quantified by the color scale (806). The color scale (806) represents increasing rock displacement (808). White, and lighter shades of gray near the wellbore wall (104) edge represent higher displacement values, i.e., complete detachment of rock segments, while dark and medium shades of gray represent stable regions (812) surrounding the wellbore wall (104), as indicated on the color scale (806). Modeled stress fractures, or cracks in the rock due to stress and pressure, are represented by thin lines (810) emanating from the wellbore wall (104). These stress fractures may not be considered rock failure if they appear in the stable region (812).

The breakout area (814) is indicated at the edge of the wellbore wall (104), where the larger values of displacement are modeled. In other words, this model predicts a wellbore breakout occurring in that region under the given parameters. In some embodiments, depending on the breakout depth, the analysis may be re-iterated using updated wellbore geometry. In other embodiments, a final mud weight may be determined based on the breakout analysis (800).

Figure 9:
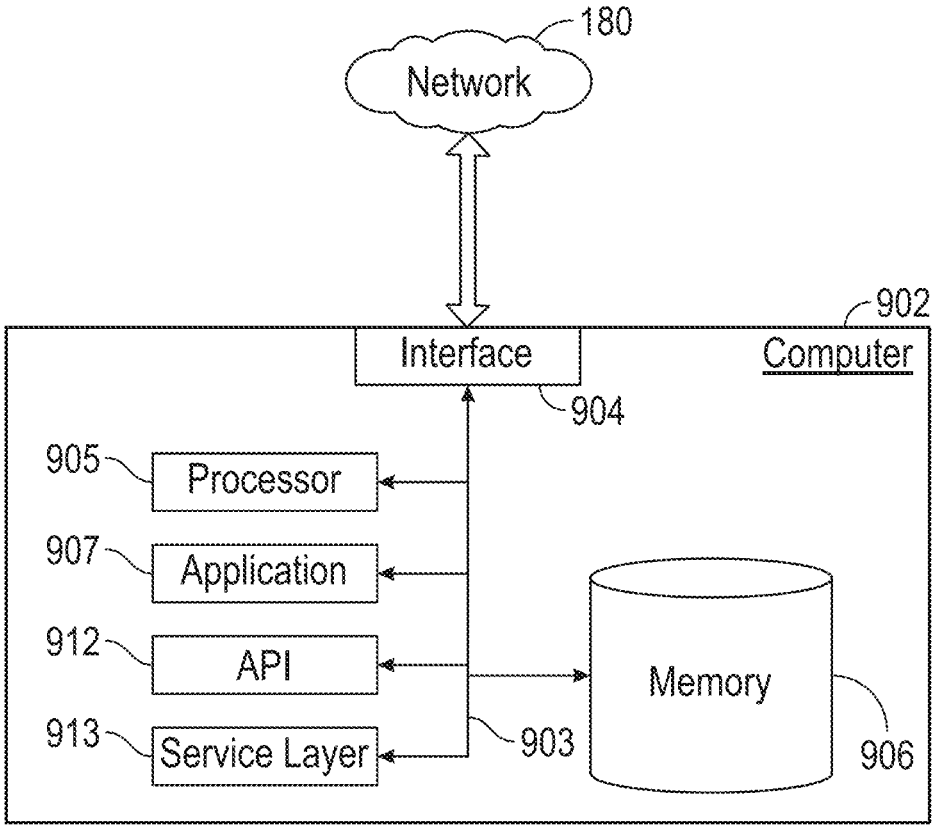
FIG. 9 depicts a block diagram of a computer system in accordance with one or more embodiments.

FIG. 9 depicts a block diagram of a computer system in accordance with one or more embodiments. The computer system is used to provide computational functionalities associated with described algorithms, methods, functions, processes, flows, and procedures as described in this disclosure, according to one or more embodiments. The illustrated computer (902) is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (902) may include a computer that includes an input device, such as a keypad, keyboard, touch screen, or other device that can accept user information, and an output device that conveys information associated with the operation of the computer (902), including digital data, visual, or audio information (or a combination of information), or a graphical user interface (GUI).

The computer (902) can serve in a role as a client, network component, a server, a database or other persistency, or any other component (or a combination of roles) of a computer system for performing the subject matter described in the instant disclosure. The illustrated computer (902) is communicably coupled with a network (180). In some implementations, one or more components of the computer (902) may be configured to operate within environments, including cloud-computing-based, local, global, or other environment (or a combination of environments).

At a high level, the computer (902) is an electronic computing device operable to receive, transmit, process, store, or manage data and information associated with the described subject matter. According to some implementations, the computer (902) may also include or be communicably coupled with an application server, e-mail server, web server, caching server, streaming data server, business intelligence (BI) server, or other server (or a combination of servers).

The computer (902) can receive requests over network (180) from a client application, for example, executing on another computer (902) and responding to the received requests by processing the said requests in an appropriate software application. In addition, requests may also be sent to the computer (902) from internal users (for example, from a command console or by other appropriate access method), external or third-parties, other automated applications, as well as any other appropriate entities, individuals, systems, or computers.

The computer (902) includes an interface (904). Although illustrated as a single interface (904) in FIG. 9, two or more interfaces (904) may be used according to particular needs, desires, or particular implementations of the computer (902). The interface (904) is used by the computer (902) for communicating with other systems in a distributed environment that are connected to the network (180). Generally, the interface (904) includes logic encoded in software or hardware (or a combination of software and hardware) and operable to communicate with the network (180). More specifically, the interface (904) may include software supporting one or more communication protocols associated with communications such that the network (180) or interface's hardware is operable to communicate physical signals within and outside of the illustrated computer (902).

The computer (902) also includes at least one computer processor (905). Although illustrated as a single computer processor (905) in FIG. 9, two or more processors may be used according to particular needs, desires, or particular implementations of the computer (902). Generally, the computer processor (905) executes instructions and manipulates data to perform the operations of the computer (902) and any algorithms, methods, functions, processes, flows, and procedures as described in the instant disclosure.

The computer (902) further includes a memory (906) that holds data for the computer (902) or other components (or a combination of both) that can be connected to the network (180). For example, memory (906) can be a database storing data consistent with this disclosure. Although illustrated as a single memory (906) in FIG. 9, two or more memories may be used according to particular needs, desires, or particular implementations of the computer (902) and the described functionality. While memory (906) is illustrated as an integral component of the computer (902), in alternative implementations, memory (906) can be external to the computer (902).

The application (907) is an algorithmic software engine providing functionality according to particular needs, desires, or particular implementations of the computer (902), particularly with respect to functionality described in this disclosure. For example, application (907) can serve as one or more components, modules, applications, etc. Further, although illustrated as a single application (907), the application (907) may be implemented as multiple applications (907) on the computer (902). In addition, although illustrated as integral to the computer (902), in alternative implementations, the application (907) can be external to the computer (902).

Each of the components of the computer (902) can communicate using a system bus (903). In some implementations, any or all of the components of the computer (902), both hardware or software (or a combination of hardware and software), may interface with each other or the interface (904) (or a combination of both) over the system bus (903) using an application programming interface (API) (912) or a service layer (913) or a combination of the API (912) and service layer (913). The API (912) may include specifications for routines, data structures, and object classes. The API (912) may be either computer-language independent or dependent and refer to a complete interface, a single function, or even a set of APIs.

The service layer (913) provides software services to the computer (902) or other components (whether illustrated or not) that are communicably coupled to the computer (902). The functionality of the computer (902) may be accessible for all service consumers using this service layer. Software services, such as those provided by the service layer (913), provide reusable, defined business functionalities through a defined interface. For example, the interface may be software written in JAVA, C++, or other suitable language providing data in extensible markup language (XML) format or another suitable format. While illustrated as an integrated component of the computer (902), alternative implementations may illustrate the API (912) or the service layer (913) as stand-alone components in relation to other components of the computer (902) or other components (whether or not illustrated) that are communicably coupled to the computer (902). Moreover, any or all parts of the API (912) or the service layer (913) may be implemented as child or sub-modules of another software module, enterprise application, or hardware module without departing from the scope of this disclosure.

There may be any number of computers (902) associated with, or external to, a computer system containing computer (902), wherein each computer (902) communicates over the network (180). Further, the term "client," "user," and other appropriate terminology may be used interchangeably as appropriate without departing from the scope of this disclosure. Moreover, this disclosure contemplates that many users may use one computer (902), or that one user may use multiple computers (902).

Although only a few example embodiments have been described in detail above, those skilled in the art will readily appreciate that many modifications are possible in the example embodiments without materially departing from this invention. Accordingly, all such modifications are intended to be included within the scope of this disclosure as limited only by the scope of the following claims.

What is claimed is:

1. A method, comprising:

obtaining a mechanical earth model (MEM) for a subterranean region, wherein the subterranean region comprises a location for a planned wellbore;

determining a critical collapse pressure (CCP) for the planned wellbore using an inclination angle and the MEM;

determining an initial mud weight based, at least in part, on the CCP;

generating a breakout analysis using the initial mud weight, the MEM and a numerical modeling algorithm;

iteratively, or recursively, until a stopping condition is met:

updating the inclination angle of the planned wellbore, updating the CCP based, at least in part, on the updated inclination angle and the MEM, and updating the breakout analysis using, at least in part, the initial mud weight, the updated CCP, the MEM, and the numerical modeling algorithm, wherein the breakout analysis comprises a breakout depth;

selecting the updated CCP based, at least in part, on the updated inclination angle that meets the stopping condition;

calculating a final mud weight for the planned wellbore based, at least in part, on the updated CCP; and conditioning a drilling mud to the final mud weight, using a mud system.

2. The method of claim 1, further comprising updating, using a wellbore planning system, the planned wellbore based, at least in part, on the final mud weight.

3. The method of claim 2, comprising drilling, using a drilling system, the updated planned wellbore.

4. The method of claim 1, wherein the MEM comprises a two-dimensional fully developed MEM.

5. The method of claim 1, wherein the breakout analysis comprises a 2D finite element model.

6. The method of claim 1, wherein determining the initial mud weight comprises:

calculating a safe mud weight window based, at least in part, on the MEM; and selecting a low mud weight between a lower limit and an upper limit of the safe mud weight window.

7. The method of claim 1, wherein the stopping condition comprises the breakout depth reaching a minimum value.

8. A non-transitory computer-readable medium having computer-executable instructions stored thereon that, when executed by a processor, performs steps comprising:

receiving a mechanical earth model (MEM) for a subterranean region, wherein the subterranean region comprises a location for a planned wellbore;

determining a critical collapse pressure (CCP) for the planned wellbore using an inclination angle and the MEM;

determining an initial mud weight based, at least in part, on the CCP;

generating a breakout analysis using the initial mud weight, the MEM and a numerical modeling algorithm;

iteratively, or recursively, until a stopping condition is met:

updating the inclination angle of the planned wellbore, updating the CCP based, at least in part, on the updated inclination angle and the MEM, and updating the breakout analysis using, at least in part, the initial mud weight, the updated CCP, the MEM, and the numerical modeling algorithm, wherein the breakout analysis comprises a breakout depth;

selecting the updated CCP based, at least in part, on the updated inclination angle that meets the stopping condition; and calculating a final mud weight for the planned wellbore based, at least in part, on the updated CCP.

9. The non-transitory computer-readable medium of claim 8, wherein the steps further comprise updating the planned wellbore based, at least in part, on the final mud weight.

10. The non-transitory computer-readable medium of claim 8, wherein the MEM comprises a two-dimensional fully developed MEM.

11. The non-transitory computer-readable medium of claim 8, wherein the breakout analysis comprises a 2D finite element model.

12. The non-transitory computer-readable medium of claim 8, wherein determining the initial mud weight comprises:

calculating a safe mud weight window based, at least in part, on the MEM; and selecting a low mud weight between a lower limit and an upper limit of the safe mud weight window.

13. The non-transitory computer-readable medium of claim 8, wherein the stopping condition comprises the breakout depth reaching a minimum value.

14. A system, comprising:

a computer processor configured to:

receive a mechanical earth model (MEM) for a subterranean region, wherein the subterranean region comprises a location for a planned wellbore;

determine a critical collapse pressure (CCP) for the planned wellbore using an inclination angle and the MEM;

determine an initial mud weight based, at least in part, on the CCP;

generate a breakout analysis using the initial mud weight, the MEM and a numerical modeling algorithm;

iterate, or recurse, until a stopping condition is met:

update the inclination angle of the planned wellbore, update the CCP based, at least in part, on the updated inclination angle and the MEM, and update the breakout analysis using, at least in part, the initial mud weight, the updated CCP, the MEM, and the numerical modeling algorithm, wherein the breakout analysis comprises a breakout depth;

select the updated CCP based, at least in part, on the updated inclination angle that meets the stopping condition; and calculate a final mud weight for the planned wellbore based, at least in part, on the updated CCP; and a mud system, configured to:

condition a drilling mud to the final mud weight.

15. The system of claim 14, further comprising a wellbore planning system configured to update the planned wellbore based, at least in part, on the final mud weight.

16. The system of claim 15, comprising a wellbore drilling system configured to drill the updated planned wellbore.

17. The system of claim 14, wherein the MEM comprises a two-dimensional fully developed MEM.

18. The system of claim 14, wherein the breakout analysis comprises a 2D finite element model.

19. The system of claim 14, wherein determining the initial mud weight comprises:

calculating a safe mud weight window based, at least in part, on the MEM; and selecting a low mud weight between a lower limit and an upper limit of the safe mud weight window.

20. The system of claim 14, wherein the stopping condition comprises the breakout depth reaching a minimum value.

* * * * *